US008165507B2

(12) United States Patent
Sakuma

(10) Patent No.: US 8,165,507 B2
(45) Date of Patent: Apr. 24, 2012

(54) IMAGE FORMATION APPARATUS AND DEVELOPER CARTRIDGE

(75) Inventor: Susumu Sakuma, Kasugai (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 13/224,616

(22) Filed: Sep. 2, 2011

(65) Prior Publication Data

US 2011/0318064 A1 Dec. 29, 2011

Related U.S. Application Data

(63) Continuation of application No. 12/342,516, filed on Dec. 23, 2008, now Pat. No. 8,027,620.

(30) Foreign Application Priority Data

Dec. 27, 2007 (JP) ..... 2007-336914

(51) Int. Cl.
*G03G 15/06* (2006.01)

(52) U.S. Cl. ..... 399/258; 399/102; 399/103; 399/110; 399/111; 399/112; 399/113; 399/119; 399/268

(58) Field of Classification Search ..... 399/102, 399/103, 110, 111, 112, 113, 119, 258, 262
See application file for complete search history.

(56) References Cited

U.S. PATENT DOCUMENTS

| | | | |
|---|---|---|---|
| 6,418,292 | B1 | 7/2002 | Isobe et al. |
| 2002/0141787 | A1 | 10/2002 | Hattori et al. |
| 2006/0051127 | A1 | 3/2006 | Kang et al. |
| 2006/0078355 | A1 | 4/2006 | Yahagi |
| 2008/0213008 | A1 | 9/2008 | Sato |
| 2008/0226339 | A1 | 9/2008 | Sato |

FOREIGN PATENT DOCUMENTS

| | | | |
|---|---|---|---|
| JP | 4-299374 | A | 10/1992 |
| JP | 04-328763 | | 11/1992 |
| JP | 05-173375 | | 7/1993 |
| JP | 06-194886 | | 7/1994 |
| JP | 2000-284579 | | 10/2000 |
| JP | 2001-222160 | | 8/2001 |
| JP | 2002-341637 | A | 11/2002 |
| JP | 2005-049900 | | 2/2005 |
| JP | 2005-338583 | | 12/2005 |
| JP | 2006-309016 | A | 11/2006 |
| JP | 2006-330151 | | 12/2006 |
| JP | 2008-216450 | | 9/2008 |
| JP | 2008-216451 | | 9/2008 |

OTHER PUBLICATIONS

Notification of Reasons for Refusal for Japanese Application 2007-336914 mailed Feb. 9, 2010.
Office Action mailed May 25, 2010 for counterpart Japanese Application 2007-336914.
Notification of Reason for Refusal dispatched Oct. 19, 2010 in Japanese Patent Application No. 2010-090369, English translation thereof.

*Primary Examiner* — David Porta
*Assistant Examiner* — Djura Malevic
(74) *Attorney, Agent, or Firm* — Banner & Witcoff, Ltd.

(57) ABSTRACT

An image formation apparatus is provided, to which developing devices, each having an opening, and developer cartridges for respectively supplying a developing agent to the openings of the developing devices are mountable. The apparatus includes: developing device shutters, each configured to open and close a respective one of the openings of the developing devices mounted to the apparatus; and a link mechanism configured to move the developing device shutters in linking with each other.

5 Claims, 12 Drawing Sheets

IMAGE FORMATION APPARATUS AND DEVELOPER CARTRIDGE

CROSS REFERENCE TO RELATED APPLICATION

This application is a continuation of prior U.S. application Ser. No. 12/342,516, filed Dec. 23, 2008. The present disclosure relates to the subject matter contained in Japanese patent application No. 2007-336914 filed on Dec. 27, 2007, which is expressly incorporated herein by reference in its entirety.

TECHNICAL FIELD

This invention relates to an image formation apparatus having a plurality of developing devices to which toner is supplied respectively from developer cartridges, and a developer cartridge.

BACKGROUND ART

Japanese Patent Laid-Open No. 194886/1994 discloses an image formation apparatus which irradiates a charged photosensitive drum with light to change the potential of the irradiated portion to thereby form an electrostatic latent image on the photosensitive drum, supplies toner to the electrostatic latent image to form a toner image, and then transfers the toner image to a record sheet to thereby form a predetermined image on the record sheet.

The image formation apparatus includes a plurality of photosensitive members, developer cartridges storing toners of different colors, and a plurality of developing devices for supplying the toners in the developer cartridges to the photosensitive members. Each of the developing devices has an opening for receiving the toner from the corresponding developer cartridge and a shutter for opening and closing the opening.

If the shutters of the developing devices as described above are opened and closed separately, there is a problem of poor operability.

SUMMARY

As one of illustrative, non-limiting embodiment, the invention can provide an image formation apparatus, to which developing devices, each having an opening, and developer cartridges for respectively supplying a developing agent to the openings of the developing devices are mountable. The apparatus includes: developing device shutters, each configured to open and close a respective one of the openings of the developing devices mounted to the apparatus; and a link mechanism configured to move the developing device shutters in linking with each other.

In another aspect, the present invention can provide a developer cartridge comprising: a plurality of developing agent accommodating frames, each configured to accommodate a developing agent and having an opening through which the developing agent is supplied to an outside of the frame; a plurality of shutters, each configured to open and close a respective one of the openings of the developing agent accommodating frames; and a link mechanism configured to link the shutters.

As one of advantages, the operability of the developing device shutters is improved.

As another one of the advantages, all of the developing device shutters can be opened or closed by one operation.

These and other advantages of the present invention will be discussed in detail with reference to an illustrative, non-limiting embodiment shown in the accompanying drawings.

BRIEF DESCRIPTION OF THE DRAWINGS

FIG. 4(*b*) is a side view to show a state in which each developing device shutter is opened; and FIG. 4(*c*) is a front view to show a state in which the drawer is seen from the front.

DESCRIPTION OF THE PREFERRED EMBODIMENT

Next, an embodiment of the invention will be discussed in detail with reference to the accompanying drawings as required.

Figure 1:
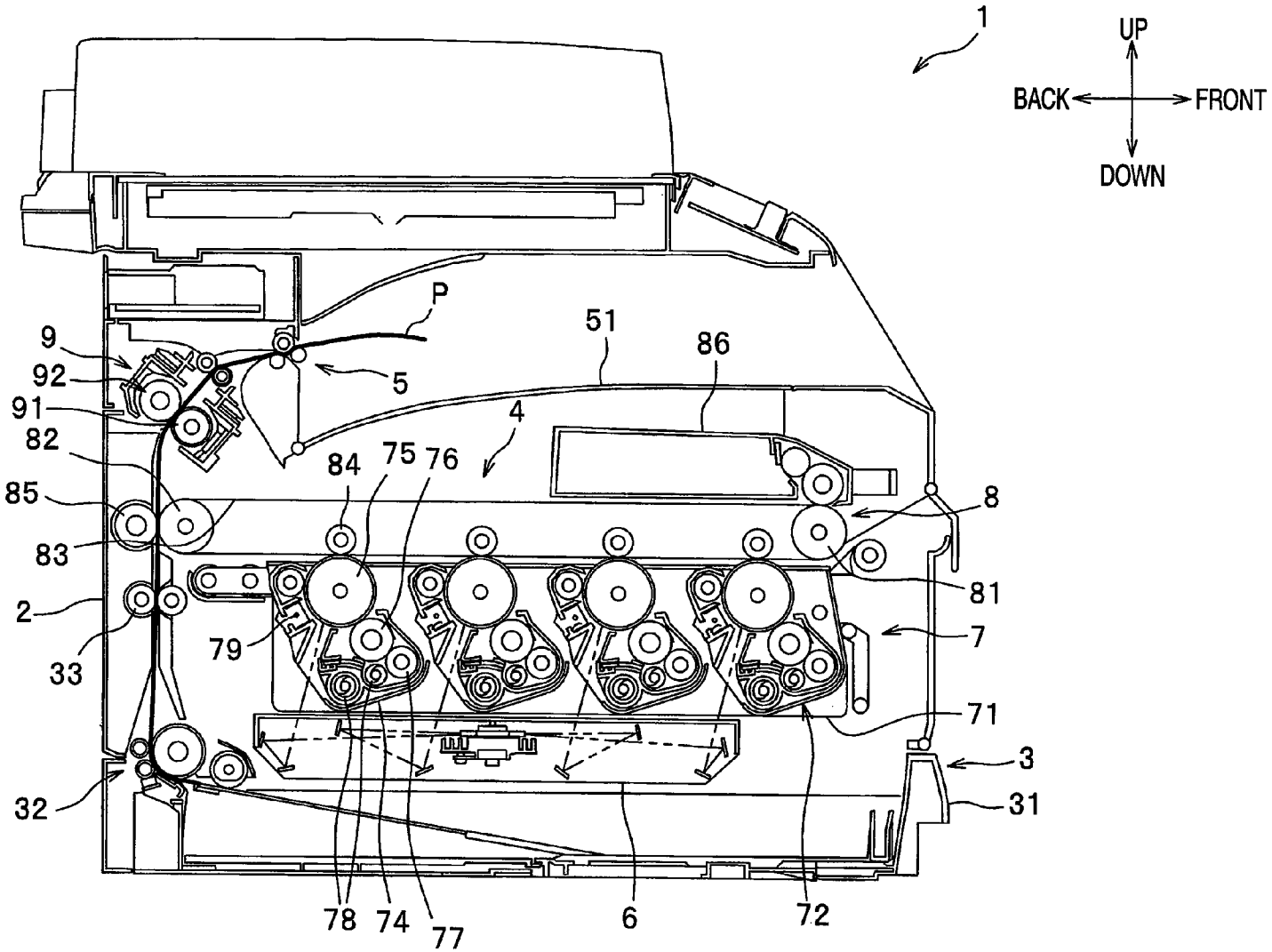
FIG. 1 is a sectional view to show the general configuration of a color printer as an example of an image formation apparatus according to an embodiment of the invention.
Figure 2:
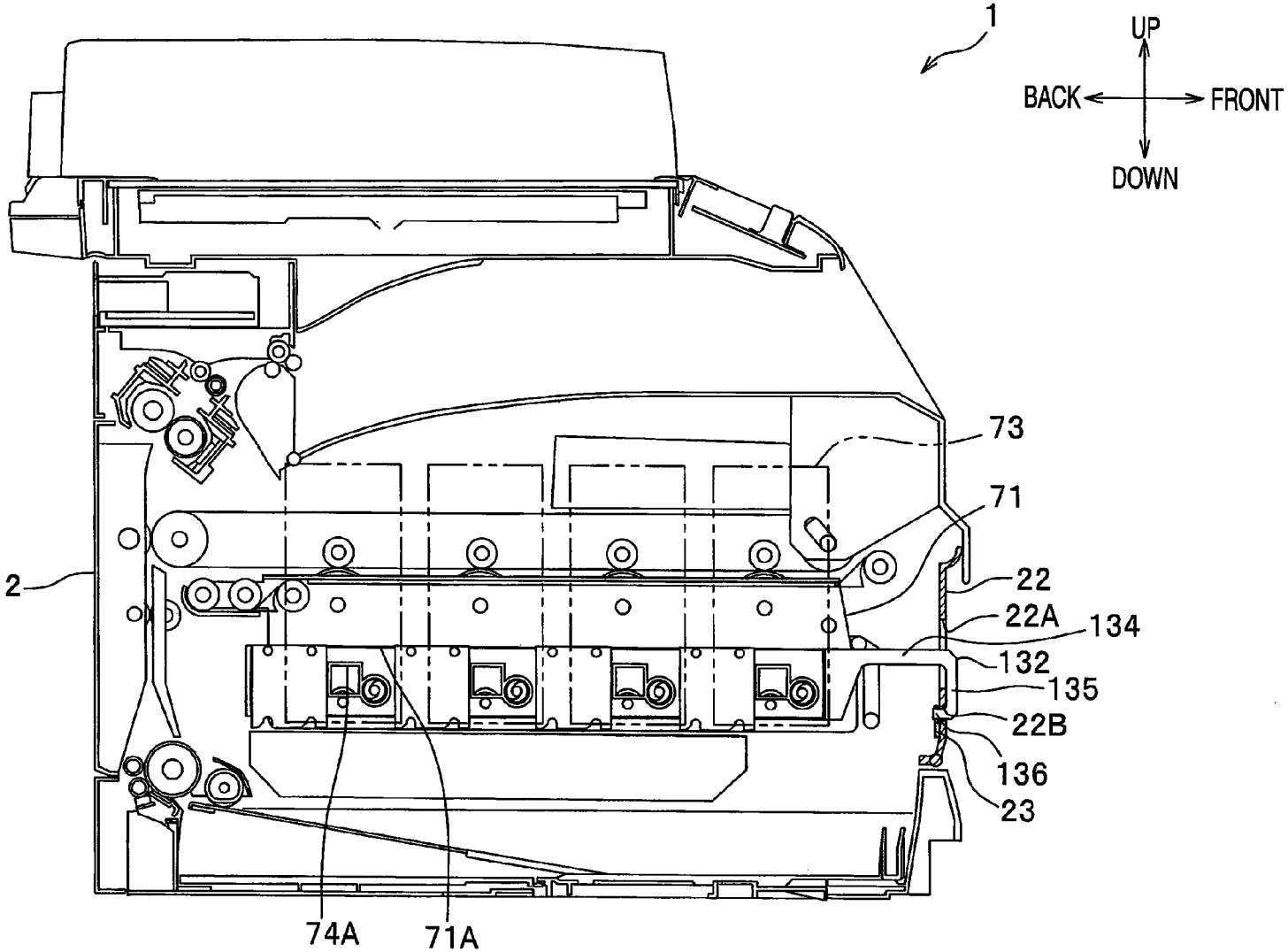
FIG. 2 is a sectional view to show openings of developing devices.
Figure 3:
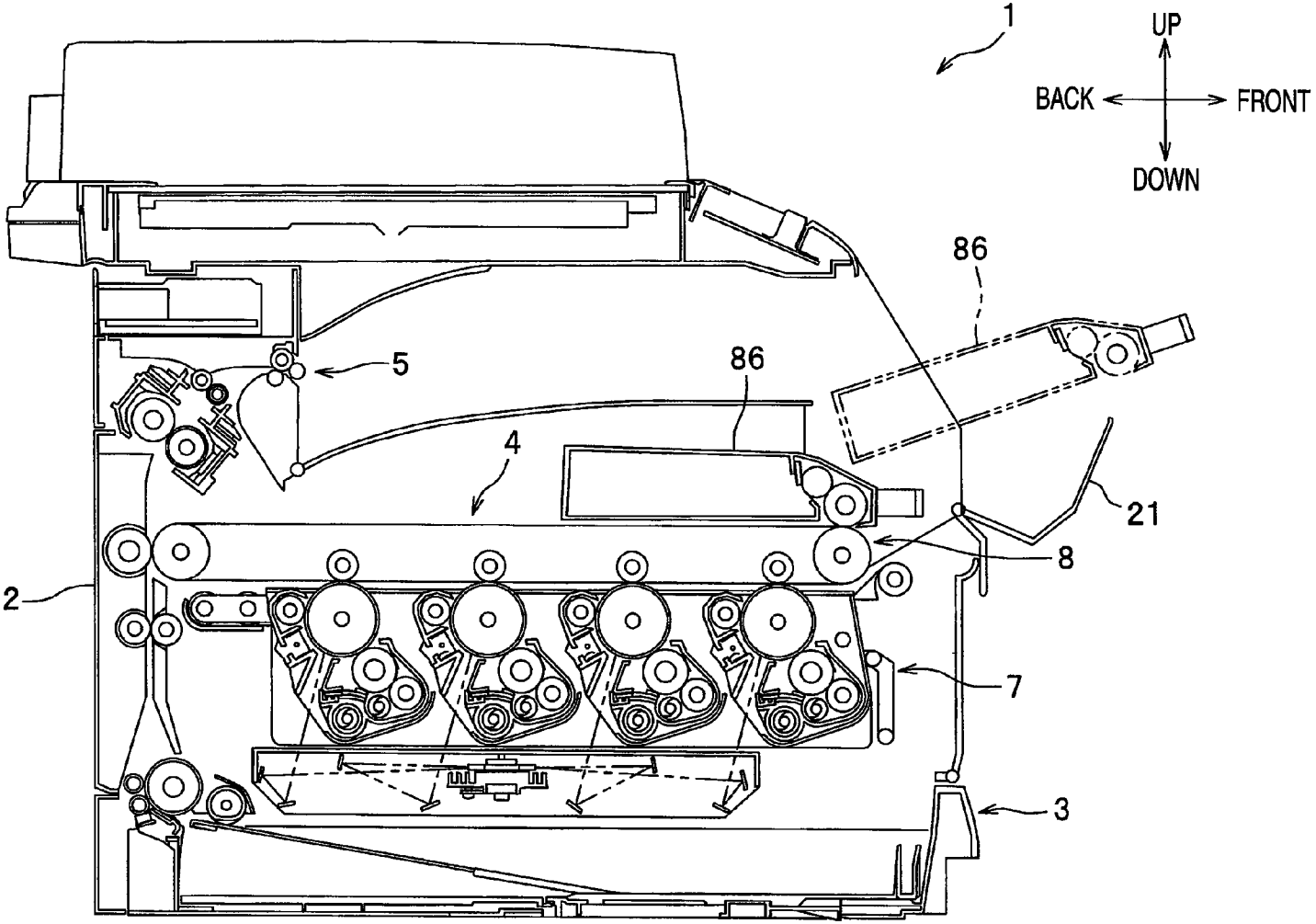
FIG. 3 is a sectional view to show the attachment-detachment structure of a cleaning unit.

In the accompanying drawings, FIG. 1 is a sectional view to show the general configuration of a color printer as an example of an image formation apparatus according to an embodiment of the invention and FIG. 2 is a sectional view to show openings of developing devices. FIG. 3 is a sectional view to show the attachment-detachment structure of a cleaning unit. In the description to follow, the general configuration of the color printer will be discussed and then the characteristic portion of the invention will be discussed in detail.

<General Configuration of Color Printer>

As shown in FIG. 1, a color printer 1 includes a sheet feed unit 3 for feeding a sheet P, an image forming unit 4 for forming an image on the fed sheet P, and a sheet discharge unit 5 for discharging the sheet P with the image formed thereon in an apparatus main body 2.

In the description to follow, unless otherwise noted, the directions are shown with the up and down direction shown in FIG. 1 as up and down (top and bottom), the right and the left in FIG. 1 as the front and the back, the back of the plane of the figure as the right, and the front of the plane of the figure as the left. The directions are defined based on the directions viewed from a person standing in front of the color printer 1. The use of these terms is intended to facilitate the understanding of the invention and should not be interpreted in a restrictive sense.

<Sheet Feed Unit>

The sheet feed unit 3 includes a sheet feed tray 31 placed detachably in the apparatus main body 2, and a sheet feed mechanism 32 and a registration roller 33 for conveying the sheet P from the sheet feed tray 31 to the image forming unit 4. The sheet feed mechanism 32 includes a known sheet feed roller, separation roller, separation rod, sheet dust removal roller (reference numeral not shown), etc., for separating the sheets P in the sheet feed tray 31 one by one and feeding the sheet P to the upper registration roller 33. The sheet P fed to the registration roller 33 is aligned at the leading end and then is conveyed to the upper image forming unit 4.

<Image Forming Unit>

The image forming unit 4 includes a scanner unit 6, a process unit 7, a transfer unit 8, and a fixing unit 9.

<Scanner Unit>

The scanner unit 6 is provided in a lower part of the apparatus main body 2 and more particularly between the sheet feed tray 31 and the process unit 7 and includes a known laser emission unit, a known polygon mirror, a plurality of known lenses, and a plurality of known reflecting mirrors (reference numeral not shown). In the scanner unit 6, a laser emitted from the laser emission unit corresponding to each color of cyan, magenta, yellow, and black passes through the passage indicated by the two-dotted chain line in the figure and is applied to a corresponding photosensitive drum 75 of the process unit 7.

[Process Unit]

The process unit 7 is disposed above the scanner unit 6 and more particularly between the scanner unit 6 and the transfer unit 8 and includes a drawer 71 shaped like a box, a plurality of developing devices 72 disposed in the drawer 71, and a plurality of developer cartridges 73 (see FIG. 2) disposed outside (at the left of) the drawer 71. The configuration of the process unit 7 will be briefly discussed hereunder, and the detailed structure will be discussed later.

The drawer 71 is mounted detachably in the apparatus main body 2 in the back and forth direction. Four (a plurality of) developing devices 72 are arranged in the back and forth direction in the drawer 71 and are fixed thereto integrally. That is, the drawer 71 enables the four developing devices 72 to be mounted to and removed from the apparatus main body 2 as one unit.

Each of the developing devices 72 mainly includes a developing case 74, the above-mentioned photosensitive drum 75 disposed in the developing case 74, a developing roller 76, a supply roller 77, a pair of conveying augers 78, and a charger 79. An opening 74A piercing the developing case 74 is formed in a lower part of the left wall of the developing case 74, as shown in FIG. 2. The opening 74A is made up of a square hole and a round hole and is disposed to face the developer cartridge 73.

With the process unit 7 thus constructed, the charger 79 charges the surface the photosensitive drum 75 positively and the charged portion is exposed to the laser light emitted from the scanner unit 6 and the potential lowers, whereby an electrostatic latent image based on image data is formed on the photosensitive drum 75. On the other hand, toner in the developer cartridge 73 shown in FIG. 2 is supplied through the opening 74A to the developing device 72 and the toner supplied to the developing device 72 is conveyed to the developing roller 76 by the conveying augers 78 and the supply roller 77. The positively charged toner is supplied from the developing roller 76 to the electrostatic latent image on the photosensitive drum 75, whereby a toner image is carried on the photosensitive drum 75. The developing agent not used for the developing is returned to the developer cartridge 73 through the opening 74A by the conveying augers 78.

[Transfer Unit]

The transfer unit 8 includes a drive roller 82, a driven roller 81, an intermediate transfer belt 83, primary transfer rollers 84, a secondary transfer roller 85, and a cleaning unit 86.

The drive roller 82 and the driven roller 81 are disposed in parallel away from each other in the back and forth direction and the endless intermediate transfer belt 83 is suspended therebetween. The intermediate transfer belt 83 is driven together with the driven roller 81 by rotation of the drive roller 82.

The primary transfer rollers 84 are disposed inside the intermediate transfer belt 83 so that the intermediate transfer belt 83 is sandwiched between the primary transfer rollers 84 and the photosensitive drums 75. A transfer bias (in the embodiment, a negative transfer bias) is applied to each primary transfer roller 84 from a high-voltage board (not shown). Accordingly, the toner image on each photosensitive drum 75 is transferred onto the intermediate transfer belt 83.

The secondary transfer roller 85 is disposed at the back of the driven roller 81. A transfer bias (in the embodiment, a negative transfer bias) is also applied to the secondary transfer roller 85 from the high-voltage board (not shown). Accordingly, the toner image on the intermediate transfer belt 83 is transferred onto the sheet P conveyed upward from the registration roller 33.

The cleaning unit 86 is disposed above the intermediate transfer belt 83 and collects the toner deposited on the intermediate transfer belt 83 and stores the toner in the cleaning unit 86. The cleaning unit 86 can be replaced by opening a first front cover 21 provided rotatably on the front of the apparatus main body 2 as shown in FIG. 3.

[Fixing Unit]

The fixing unit 9 is disposed downstream from the transfer unit 8 and more particularly above the secondary transfer roller 85 and includes a known heating roller 91 and a known pressing roller 92. The fixing unit 9 thermally fixes the toner image on the sheet P by delivering the sheet P while nipping the sheet P between the heating roller 91 and the pressing roller 92.

<Sheet Discharge Unit>

The sheet discharge unit 5 has a plurality of conveying rollers (reference numeral not shown) and conveys the sheet P discharged from the fixing unit 9 to a sheet discharge tray 51 formed in an upper part of the apparatus main body 2.

Figure 4:
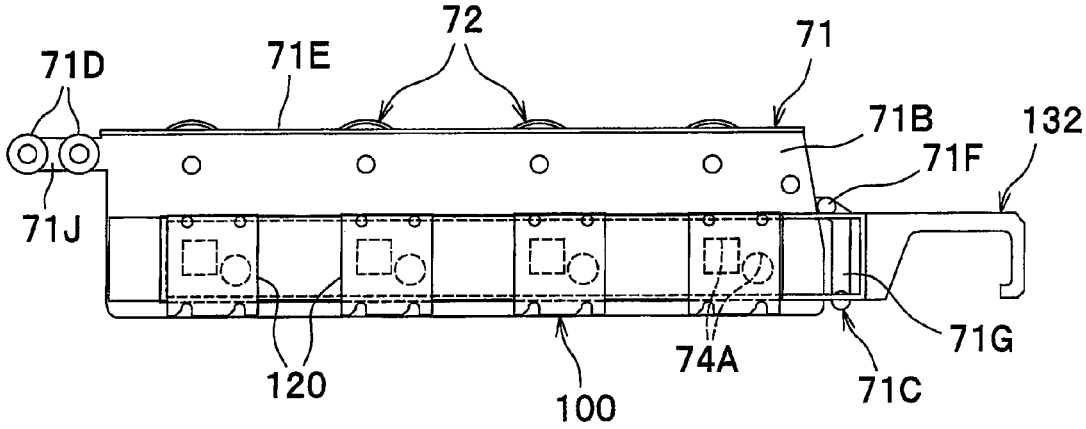
FIG. 4(*a*) is a side view to show a state in which a drawer with each developing device shutter closed is seen from the left.
Figure 4:
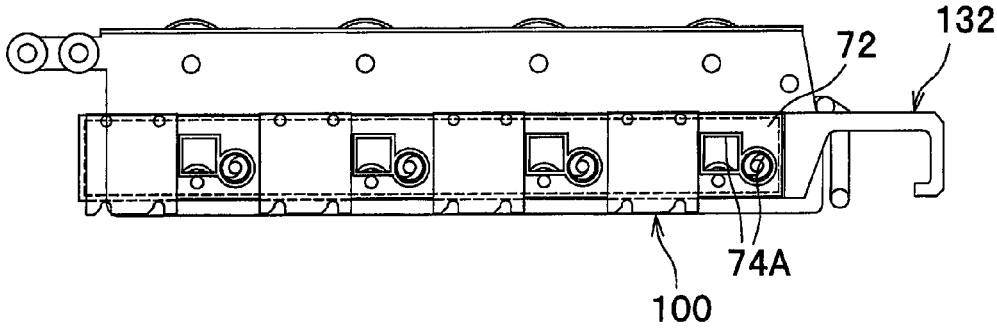
Figure 4:
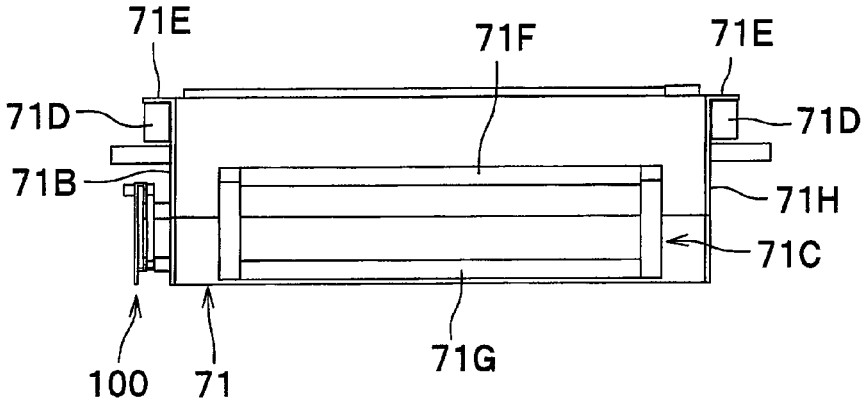
Figure 5:
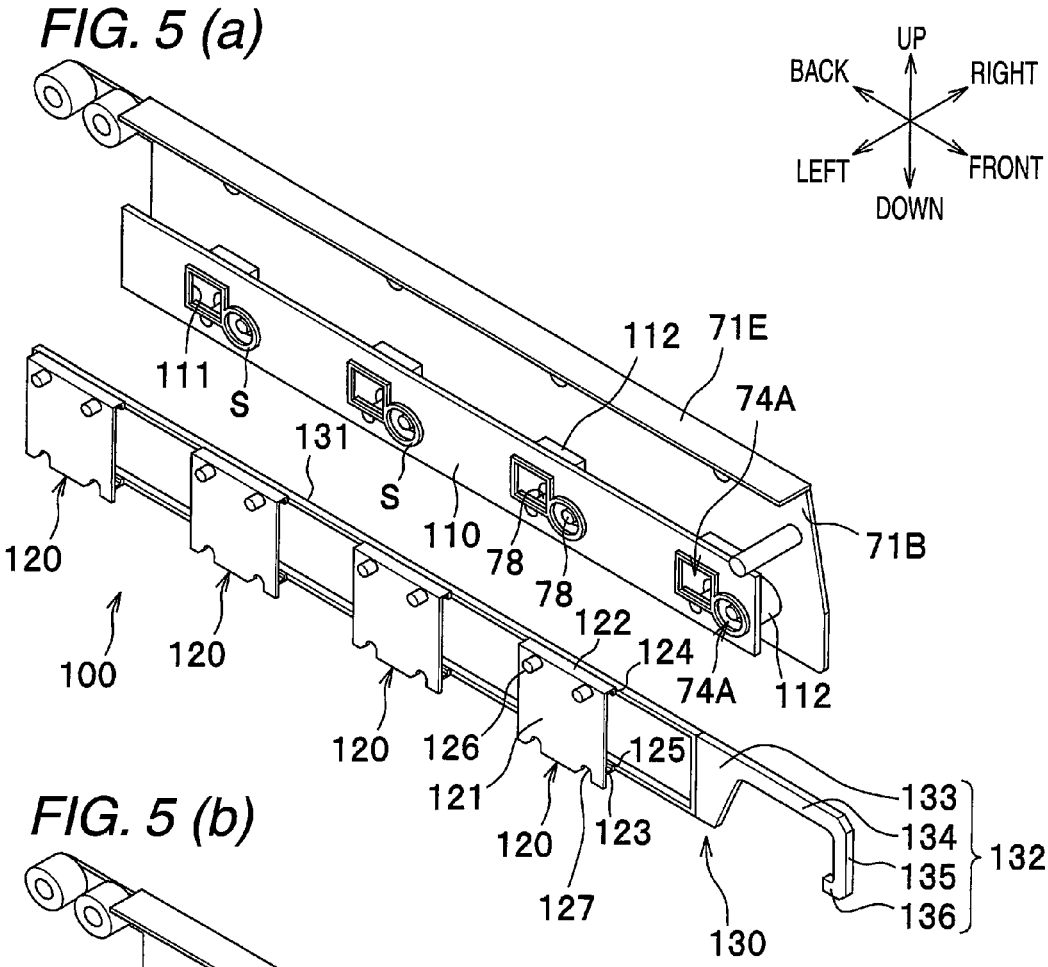
FIG. 5(*a*) is an exploded perspective view to show a shutter mechanism in a disassembly state and FIG. 5(*b*) is a perspective view to show the shutter mechanism in an assembly state.
Figure 5:
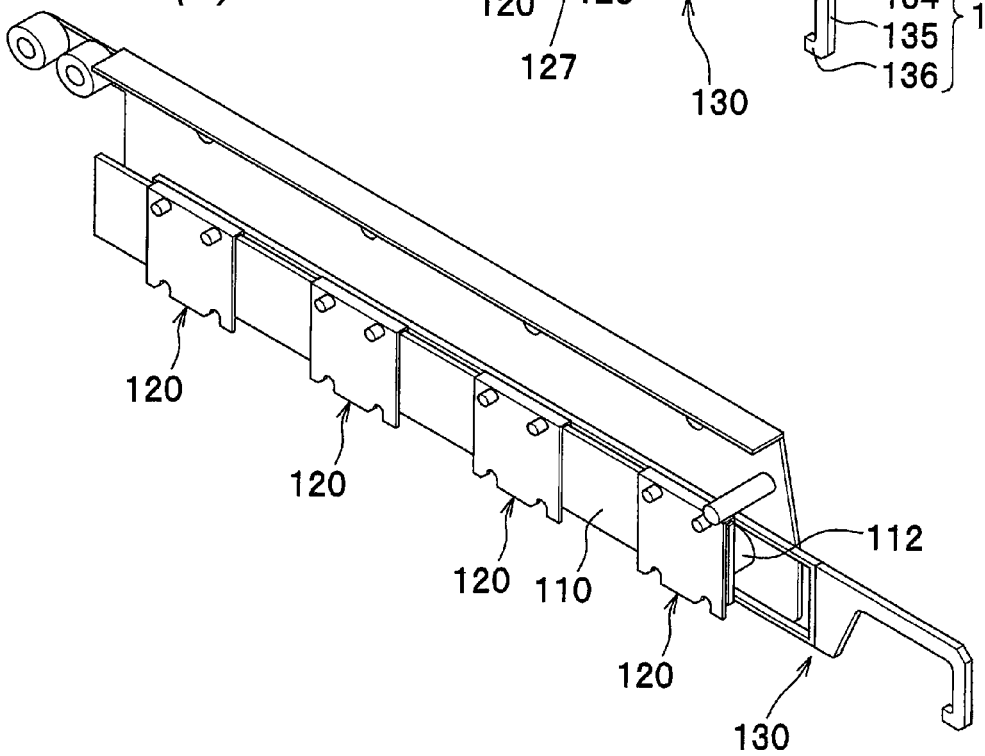
Figure 6:
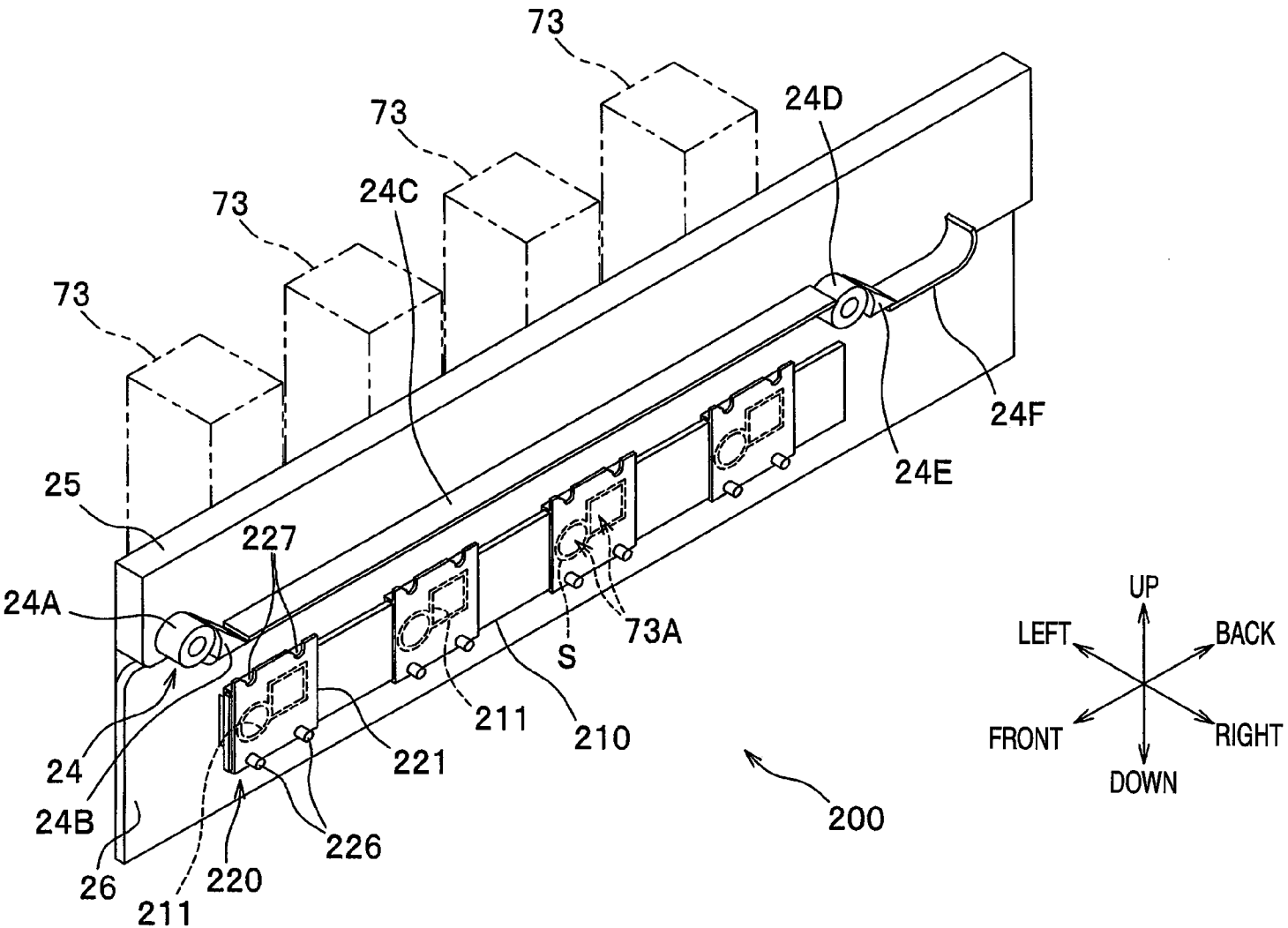
FIG. 6 is a perspective view to show a guide unit and a cartridge shutter mechanism.

Next, the structure of the characteristic portion of the invention, namely, the shutter structure for opening and closing the openings 74A of the developing devices 72 will be discussed in detail. In the accompanying drawings, FIG. 4(*a*) is a side view to show a state in which the drawer with each developing device shutter closed is seen from the left; FIG. 4(*b*) is a side view to show a state in which each developing device shutter is opened; and FIG. 4(*c*) is a front view to show a state in which the drawer is seen from the front. FIG. 5(*a*) is an exploded perspective view to show a shutter mechanism in a disassembly state and FIG. 5(*b*) is a perspective view to show the shutter mechanism in an assembly state. FIG. 6 is a perspective view to show a guide unit and a cartridge shutter mechanism.

As shown in FIGS. 4(*a*) to 4(*c*), a shutter mechanism 100 for opening or closing the openings 74A of the four developing devices 72 at the same time is provided in a lower part of a left wall 71B of the drawer 71. The shutter mechanism 100 includes a shutter support wall 110, four (a plurality of)

developing device shutters 120, and a shutter joint 130 for joining the developing device shutters 120 as shown in FIGS. 5(*a*) and 5(*b*).

The shutter support wall 110 is a rectangular plate-like component extending in the back and forth direction and has four openings 111 formed in a one-to-one correspondence with the openings 74A of the developing cases 74 and a sponge S shaped following the outer periphery of the opening 111 is joined to the surrounding of the opening 111. The shutter support wall 110 is fixed to the left wall 71B of the drawer 71 via support rods 112 and thus is disposed at a predetermined spacing from the left wall 71B of the drawer 71. Each of the support rods 112 is formed in a hollow cylindrical shape having an opening corresponding to a respective one of the openings 74A of the developing cases 74.

The developing device shutter 120 is formed substantially like a letter C in cross section and is attached to the shutter support wall 110 slidably in the back and forth direction. Specifically, the developing device shutter 120 has a longitudinal wall 121 formed like a rectangle, an upper wall 122 and a lower wall 123 extending to the right from the upper and lower ends of the longitudinal wall 121, a claw part 124 extending downward from the right edge of the upper wall 122, and a claw part 125 extending upward from the right edge of the lower wall 123.

The longitudinal wall 121 of the developing device shutter 120 is formed at an upper part thereof with two columnar projections 126 projecting to the left and being arranged side by side in the back and forth direction. The longitudinal wall 121 is also formed at a lower part thereof with two concave parts 127 arranged side by side in the back and forth direction. The projections 126 and the concave parts 127 are located at the same positions in the back and forth direction (that is, the projections 126 overlap the concave parts 127 when viewed in the up and down direction). Each projection 126 and each concave part 127 correspond to an example of an engagement part.

The shutter joint 130 is disposed between the shutter support wall 110 and the left wall 71B of the drawer 71 and includes a rectangular frame part 131 having substantially the same size as the shutter support wall 110 and a shutter operation part 132 formed on the front of the frame part 131 (the detachment side in the attachment-detachment direction of the drawer 71). The claw parts 124 and 125 of the four developing device shutters 120 are joined to the frame part 131. Accordingly, when the shutter operation part 132 is moved in the back and forth direction, the four developing device shutters 120 is correspondingly moved in the back and forth direction (in the direction in which the developing devices 72 are arrayed).

The shutter operation part 132 has a base part 133 integral with the frame part 131, a first extension part 134 extending to the front from the top of the base part 133, a second extension part 135 extending downward from the tip of the first extension part 134, and a third extension part 136 extending to the back from the lower end of the second extension part 135. The back and forth movable range of the shutter operation part 132 is defined by a movement regulation part (not shown).

Accordingly, if the shutter operation part 132 is moved to a closed position on the front, the developing device shutters 120 close the openings 74A of the developing devices 72, as shown in FIG. 4(*a*). If the shutter operation part 132 is moved to an open position at the back, the developing device shutters 120 is moved to the back and the openings 74A of the developing devices 72 are opened, as shown in FIG. 4(*b*).

The sponge S is joined to the surrounding of the opening 111 of the shutter support wall 110 shown in FIG. 5(*a*) as described above. Accordingly, when the developing device shutter 120 is closed, the sponge S comes in close contact with and presses against the developing device shutter 120 to seal the developing device 72. When the developing device shutter 120 is opened, the sponge S expands toward the developer cartridge 73 because of its elasticity.

When the shutter operation part 132 is at the open position, the first extension part 134 of the shutter operation part 132 passes through a through hole 22A of a second front cover 22 provided pivotably on the front of the apparatus main body 2 and the second extension part 135 is located at the front of the apparatus main body 2 so that the third extension part 136 is engaged with a through hole 22B of the second front cover 22. Accordingly, the second front cover 22 cannot be opened unless the shutter operation part 132 is moved to the closed position.

Figure 10:
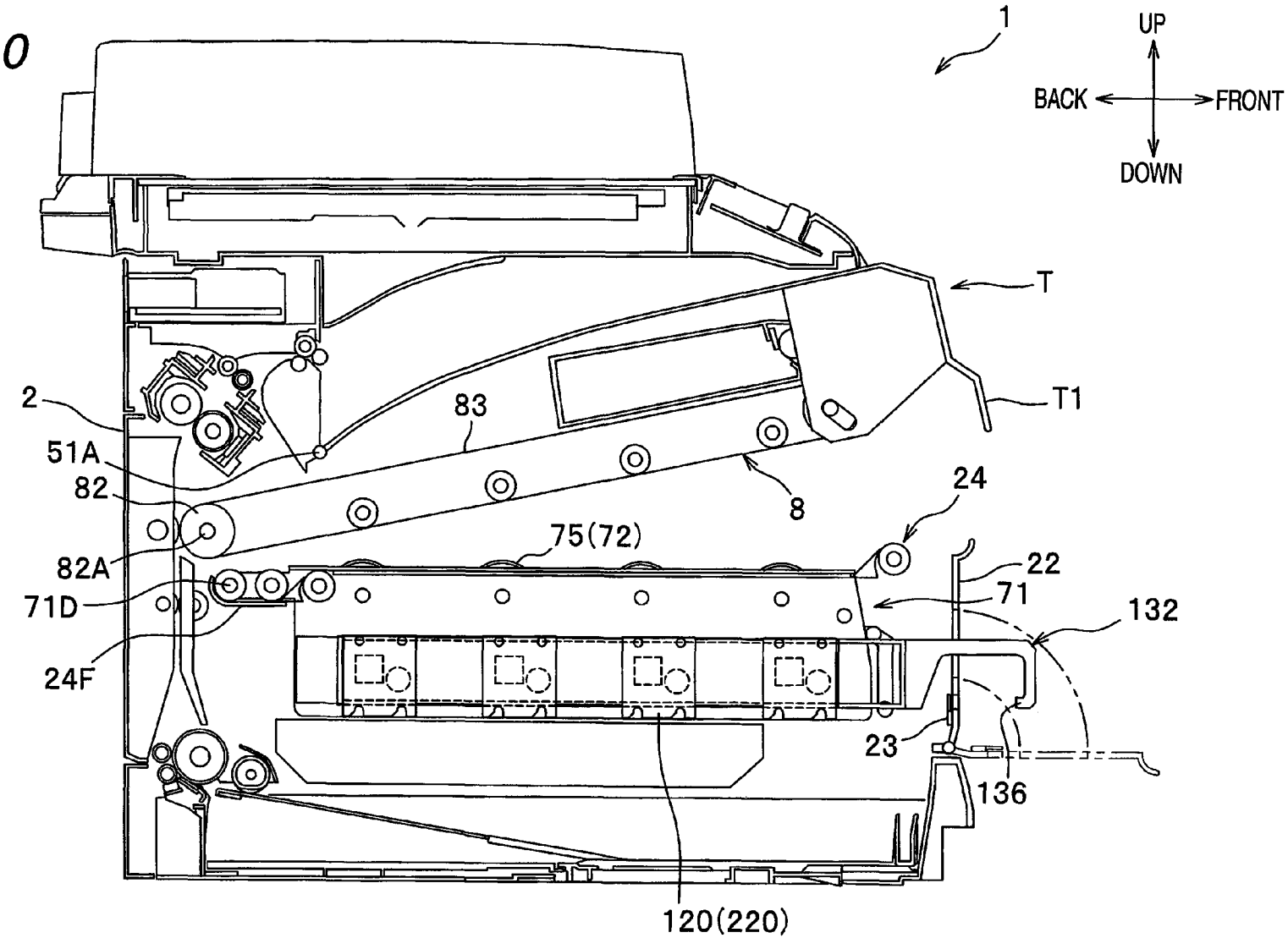
FIG. 10 is a sectional view to show a state in which the second front cover is closed.

The through hole 22A has such a size as to prevent the second front cover 22 and the shutter operation part 132 from interfering with each other when the second front cover 22 is rotated in a state in which the shutter operation part 132 is at the closed position (see FIG. 10).

Pivotable movement of the second front cover 22 toward the front is regulated by a gripper T1 of a top cover T disposed above the second front cover 22. The top cover T is rotated up and down about a shaft part 51A disposed at the back of the sheet discharge tray 51, and the transfer unit 8 is rotated up and down about a rotation shaft 82A of the driven roller 81 in linking with the rotation of the top cover T as shown in FIG. 10.

Further, as shown in FIG. 2, the third extension part 136 of the shutter operation part 132 is fitted into the engagement hole 22B of the second front cover 22 from the front in a state in which the shutter operation part 132 is at the open position.

An optical sensor 23 for detecting the position of the shutter operation part 132 is provided in the apparatus main body 2. Specifically, as the shutter operation part 132 at the open position shuts out light, the optical sensor 23 detects that the shutter operation part 132 is at the open position; as the shutter operation part 132 moves to the closed position and shutting out the light is released, the optical sensor 23 detects that the shutter operation part 132 is at the closed position.

As shown in FIGS. 4(*a*) to 4(*c*), the drawer 71 is provided with a drawer operation part 71C as an example of a developing device operation part on the front of the drawer 71 (the detachment side in the attachment-detachment direction) and is provided on the top with wheels 71D and slide flanges 71E so that the drawer 71 can be attached and detached in the same direction as the move direction of the developing device shutters 120.

The drawer operation part 71C has a rotation shaft part 71F fixed to the front face of the drawer 71 and a gripper 71G provided rotatably on the rotation shaft part 71F. The rotation shaft part 71F extends in the left-right direction and the gripper 71G rocks up and down with the rotation shaft part 71F as the center.

As shown in FIGS. 4(*a*) to 4(*c*), two wheels 71D are rotatably provided on each of projection pieces 71J, projecting from the back top of left and right side walls 71B and 71H of the drawer 71 to the back, to be aligned in the back and forth direction.

The slide flange 71E respectively extends from the left and right side walls 71B and 71H of the drawer 71 to the outside in the left-right direction as shown in FIG. 4(*c*).

On the other hand, as shown in FIG. 6, the apparatus main body 2 has guide units 24, disposed at the left and right sides of the drawer 71, for guiding the drawer 71 to a predetermined position. In FIG. 6, only the left guide unit 24 is shown.

Specifically, each of the guide units 24 includes a first guide roller 24A, a first inclined wall 24B, a first guide rail 24C, a second guide roller 24D, a second inclined wall 24E, and a second guide rail 24F disposed in this order from the front to the back.

The first guide roller 24A is provided rotatably on a wall 25 forming a part of the apparatus main body 2. The first guide rail 24C is formed like a plate extending in the back and forth direction and is located substantially at the same position as the lower part of the first guide roller 24A in the up and down direction. The first inclined wall 24B has a slope inclined from the upper part of the first guide roller 24A to the top face of the first guide rail 24C.

The second guide roller 24D is provided rotatably on the wall 25 forming a part of the apparatus main body 2 and is located so that the upper part thereof is substantially at the same position as the first guide rail 24C in the up and down direction. The second guide rail 24F is formed like a plate extending in the back and forth direction with the back end part bent upward and is located substantially at the same position as the lower part of the second guide roller 24D in the up and down direction. The second inclined wall 24E has a slope inclined from the upper part of the second guide roller 24D to the top face of the second guide rail 24F.

Since the guide units 24 and the drawer 71 are thus configured, when the drawer 71 is inserted into the apparatus main body 2, the wheels 71D of the drawer 71 roll on the first guide rollers 24A, the first inclined walls 24B, and the first guide rails 24C of the guide units 24 and proceed to the back. When the wheels 71D of the drawer 71 arrive at the first guide rails 24C, the slide flanges 71E of the drawer 71 are placed on the first guide rollers 24A.

Accordingly, the wheels 71D of the drawer 71 roll on the first guide rails 24C and proceed to the back and the slide flanges 71E of the drawer 71 are slid to the back by rolling of the first guide rollers 24A, whereby the drawer 71 moves to the back in a stable attitude. Then, the wheels 71D of the drawer 71 roll on the second guide rollers 24D, the second inclined walls 24E, and the second guide rails 24F and are stopped at the bent back end parts of the second guide rails 24F, whereby the drawer 71 moves obliquely downward and backward to be positioned at a predetermined position.

A cartridge shutter mechanism 200 for allowing and shutting out supply of toner from each developer cartridge 73 to each developing device 72 (collection of toner from each developing device 72 to each developer cartridge 73) is provided below the guide unit 24. Specifically, the cartridge shutter mechanism 200 has a substantially similar structure to that of the shutter mechanism 100 of the drawer 71 and mainly includes a shutter support wall 210 and four (a plurality of) cartridge shutters 220.

The shutter support wall 210 has four openings 211 like the shutter support wall 110 of the drawer 71 and is fixed to a wall 26 forming a part of the apparatus main body 2 with a predetermined spacing therebetween. A sponge S of the same shape as the sponge S of the developing device 72 is fixed to the surrounding of each opening 211. When the cartridge shutter 220 is closed, the sponge S is in close contact with the cartridge shutter 220; when the cartridge shutter 220 is opened, the sponge S expands to the outside and comes in close contact with the sponge S of the developing device 72.

Each cartridge shutter 220 is disposed between a respective developer cartridge 73 and a respective developing device 72 and has such a structure that the developing device shutter 120 of the drawer 71 is placed in an inverted position. That is, a longitudinal wall 221 of the cartridge shutter 220 is formed at its upper part with a pair of concave parts 227 and at its lower part with a pair of projections 226.

Thus, the pair of projections 126 of each developing device shutter 120 engages the pair of concave parts 227 of the respective cartridge shutter 220 and the pair of concave parts 127 of each developing device shutter 120 engages the pair of projections 226 of the respective cartridge shutter 220. Each concave part 227 and each projection 226 of the cartridge shutter 220 correspond to an example of an engaged part.

An opening 73A of the same shape as the opening 74A formed in the lower part of each developing device 72 is formed in a lower part of each developer cartridge 73 and is opened to the developing device 72 through the opening 211 of the shutter support wall 210.

In addition, each developer cartridge 73 has a shutter opening-closing mechanism, which can be set as desired. For example, the shutter opening-closing mechanism can be set so that the shutter is opened in linking with the attaching operation of the developer cartridge 73 by engagement of the shutter with a part of the apparatus main body 2 when the developer cartridge 73 is attached to the apparatus main body 2. Alternatively, the mechanism can be set so that the shutters of the developer cartridges 73 are opened or closed separately or at the same time by operating an operation piece (not shown) after the developer cartridges 73 are attached to the apparatus main body 2. Each developer cartridge 73 may have a sponge which expands to the outside from the developer cartridge 73 to be brought in close contact with the wall 26 of the apparatus main body 2 when the shutter of the developer cartridge 73 is opened.

With the developer cartridges 73, the developing device shutter mechanism 100 and the cartridge shutter mechanism 200 configured as described above, when the drawer 71 is moved in the back and forth direction along the guide units 24 and then moved obliquely downward and backward to arrive at the predetermined position, the pair of projections 126 and the pair of concave parts 127 of each developing device shutter 120 engage the pair of concave parts 227 and the pair of projections 226 of the corresponding cartridge shutter 220. Accordingly, when the drawer 71 is located at the predetermined position, all of the developing device shutters 120 and the cartridge shutters 220 can be simultaneously opened or closed in linking with each other by operating the shutter operation part 132 of the drawer 71.

When the developing device shutter 120 and the cartridge shutter 220 are opened, the sponges S is out of contact with the developing device shutter 120 and the cartridge shutter 220 and thus expand to abut against each other. Consequently, a toner passage is defined to connect the developer cartridge 73 to the developing device 72, thereby making it possible to supply toner from the developer cartridge 73 to the developing device 72.

Figure 7:
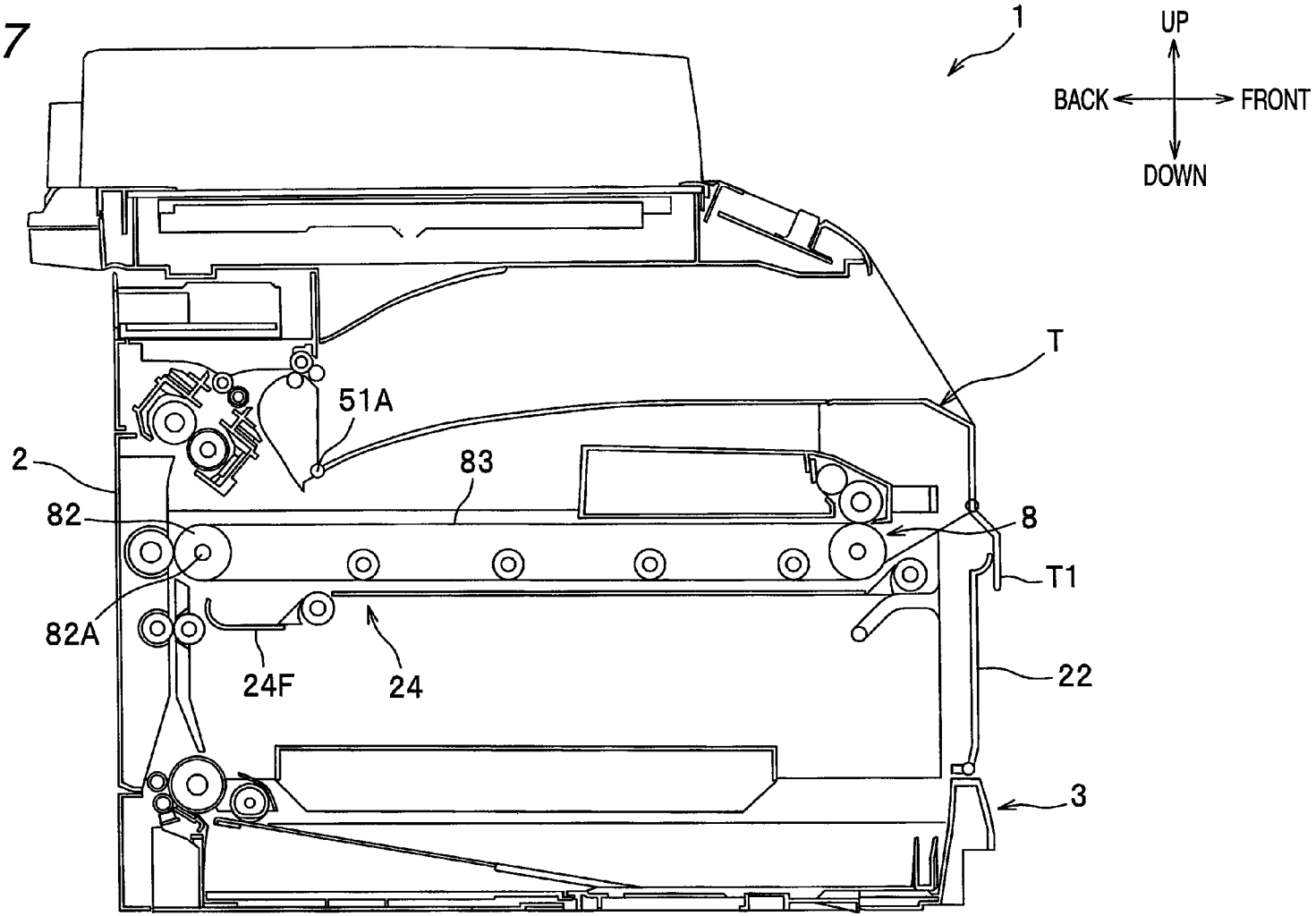
FIG. 7 is a sectional view to show the apparatus main body in which the drawer is not placed.
Figure 8:
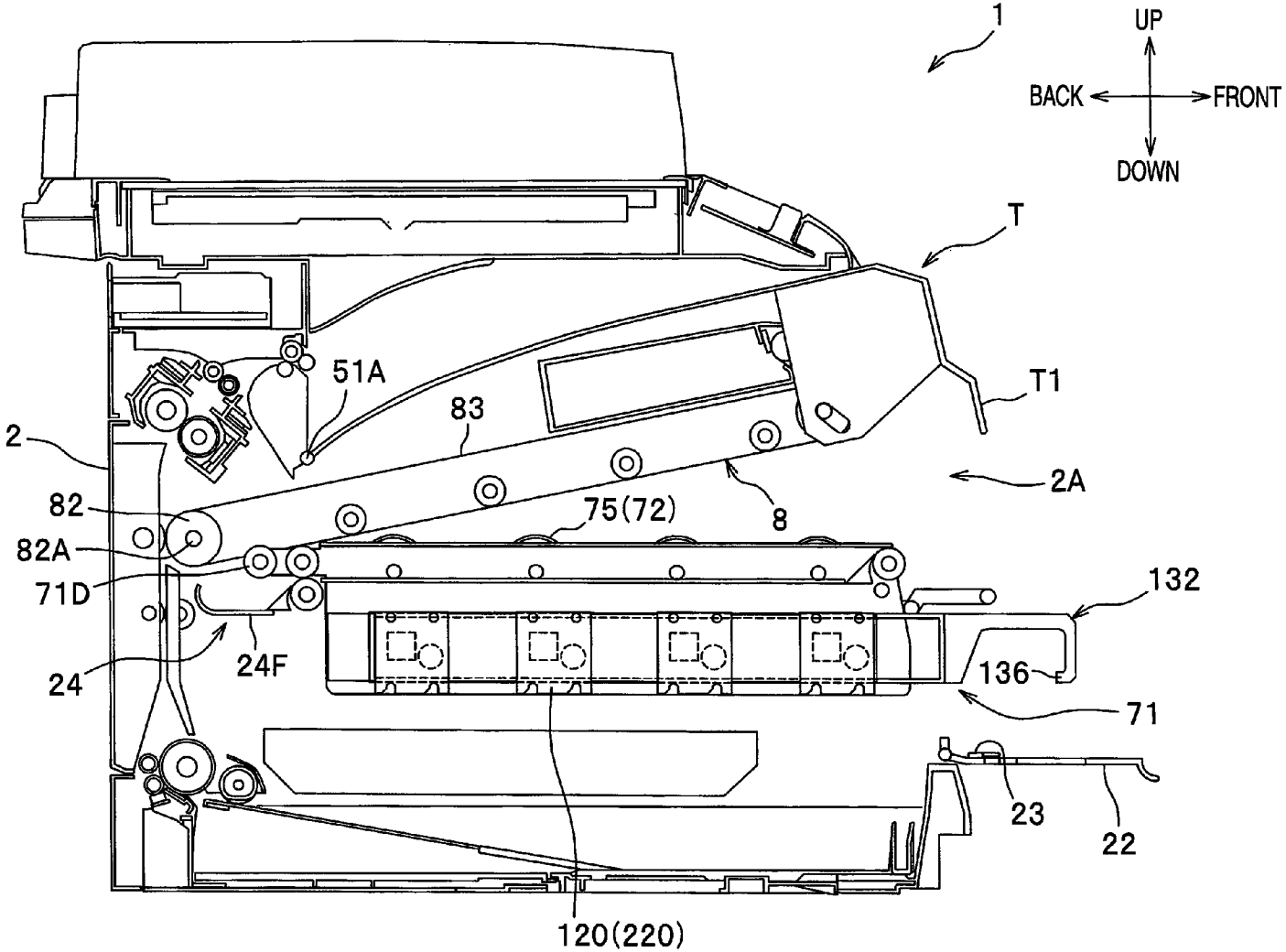
FIG. 8 is a sectional view to show a state in which a top cover and a second front cover are opened.
Figure 9:
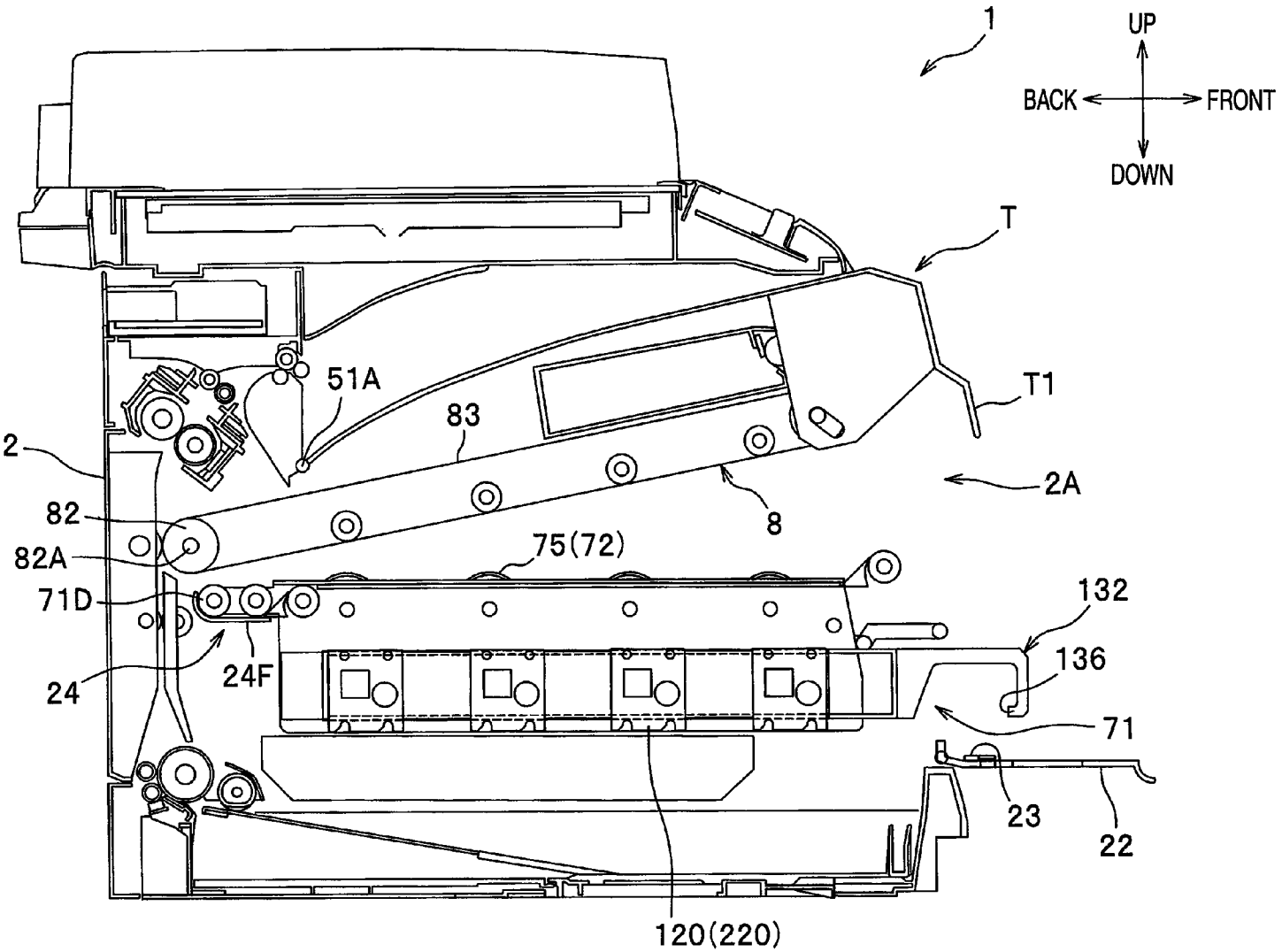
FIG. 9 is a sectional view to show a state in which the drawer is inserted to a predetermined position.
Figure 11:
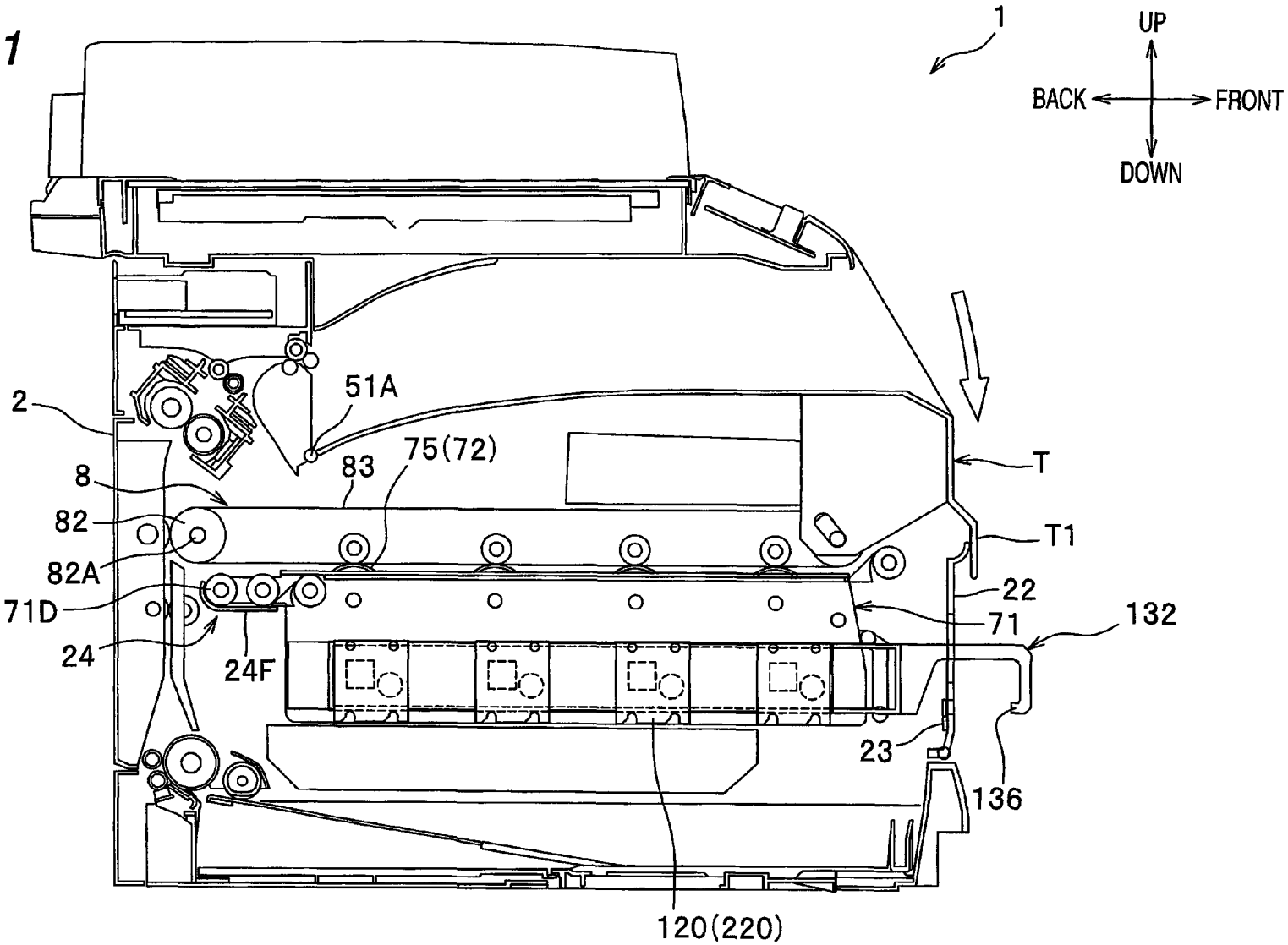
FIG. 11 is a sectional view to show a state in which the top cover is closed.
Figure 12:
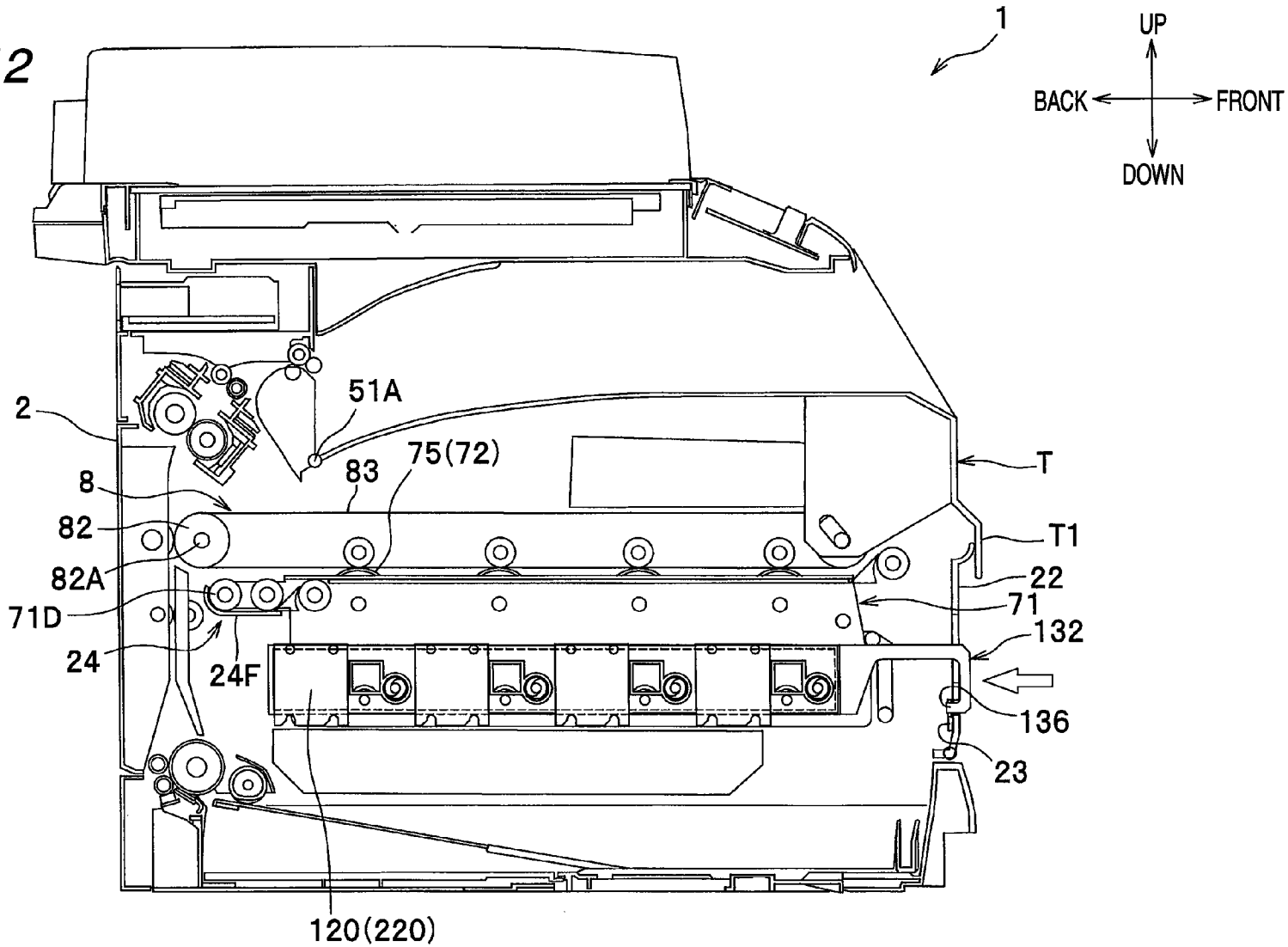
FIG. 12 is a sectional view to show a state in which the developing device shutters are opened.

Next, an operation method of the color printer 1 according to the embodiment will be discussed. In the accompanying drawings, FIG. 7 is a sectional view to show the apparatus main body in which the drawer is not placed and FIG. 8 is a sectional view to show a state in which the top cover and the second front cover are opened. FIG. 9 is a sectional view to show a state in which the drawer is inserted to the predetermined position and FIG. 10 is a sectional view to show a state in which the second front cover is closed. Further, FIG. 11 is a sectional view to show a state in which the top cover is closed and FIG. 12 is a sectional view to show a state in which the developing device shutters are opened.

In a state in which the drawer 71 is not placed in the apparatus main body 2 as shown in FIG. 7, the top cover T is pivotably moved upward and then the second front cover 22 is tilted to the front to form an opening 2A to insert the drawer 71 on the front of the apparatus main body 2 as shown in FIG. 8. The drawer 71 is inserted through the opening 2A to the back along the guide units 24.

When the wheels 71D at the leading end of the drawer 71 in the insertion direction are moved to the bent back end parts of the second guide rails 24F of the guide units 24, the drawer 71 is entirely lowered obliquely backward and is positioned at the predetermined position as shown in FIG. 9. Concurrently, the projections 126 and the concave parts 127 of the developing device shutters 120 shown in FIG. 5 respectively engage the concave parts 227 and the projections 226 of the cartridge shutters 220 shown in FIG. 6.

Then, the second front cover 22 is pivotably moved upward and closed as shown in FIG. 10. The top cover T is pivotably moved downward and closed as shown in FIG. 11, so that the intermediate transfer belt 83 of the transfer unit 8 abuts against the photosensitive drums 75 provided in the developing devices 72 in the drawer 71.

Then, the shutter operation part 132 is pushed to the open position at the back to open all of the developing device shutters 120 and the cartridge shutters 220 in linking with each other. Consequently, toner can be supplied from each of the developer cartridges 73 (see FIG. 2) to a corresponding one of the developing devices 72. At the open position, the third extension part 136 of the shutter operation part 132 shuts out light of the optical sensor 23, and therefore the optical sensor 23 detects a state in which the shutter operation part 132 is located at the open position.

Upon receiving a detection signal of the optical sensor 23, the color printer 1 is put into a printable state. That is, when the optical sensor 23 detects that the shutter operation part 132 is located at the open position, a controller (not shown) for controlling the color printer 1 allows the later print control; while the optical sensor 23 does not detect that the shutter operation part 132 is at the open position, the controller inhibits print control. Thus, execution of print control is prevented when the developing device shutters 120 and the cartridge shutters 220 are closed.

To take out the drawer 71 from the color printer 1, the shutter operation part 132 is pulled to the closed position at the front to close all of the developing device shutters 120 and the cartridge shutters 220 as shown from FIG. 12 to FIG. 11. Then, the top cover T and the second front cover 22 are opened in this order to form the opening 2A on the front of the apparatus main body 2 as shown from FIG. 10 to FIG. 9, and the drawer 71 is drawn out through the opening 2A and is taken out.

Accordingly, the embodiment can provide the following advantages:

The developing device shutters 120 are operatively linked with each other. Accordingly, all of the developing device shutters 120 can be simultaneously opened or closed by one operation. That is, the operability of the developing device shutters can be improved.

The developing device shutters 120 are moved in the direction in which the developing devices 72 are arrayed. Accordingly, the shutter joint 130 joining the developing device shutters 120 can be moved in the longitudinal direction. This arrangement can suppress distortion of the shutter joint 130 and permit the developing device shutters 120 to be moved smoothly. In this connection, the shutter joint 130 can be arranged to move up and down to open and close the developing device shutters 120 in linking with each other. In this case, however, the shutter joint 130 may rotate on the slide contact part with the sponge S of the developing device 72, for example, and thus it is feared that the shutter joint 130 will be distorted and the developing device shutters 120 will not be smoothly moved.

Because the developing devices 72 are fixed to the drawer 71, the developing devices 72 can be mounted to and removed from the apparatus main body 2 as a unit construction. Accordingly, the developing devices 72 can be simultaneously replaced in a state in which the developing device shutters 120 are joined, and therefore the structure can be simplified. In this connection, in a case in which the developing devices are separately mounted to and removed from the apparatus main body 2, it is required to have a mechanism for separately releasing the joint of the developing device shutters for replacement, and therefore the structure becomes complicated.

Since the drawer operation part 71C and the shutter operation part 132 are both provided on the detachment side in the attachment-detachment direction, the operability of the drawer 71 and the developing device shutters 120 by the user operating on the detachment side is improved. The attachment-detachment direction of the drawer 71 and the moving direction of the developing device shutters 120 are the same. Accordingly, the space used to attach or detach the drawer 71 and the space used to open or close the developing device shutters 120 can be shared and therefore the effective use of the space can be realized.

Since the apparatus main body 2 is provided with the optical sensor 23 for detecting the position of the shutter operation part 132, the printer 1 can surely determine the open state and closed state of the developing device shutters 120 based on the output signal of the optical sensor 23. Accordingly, malfunction of print control can be prevented. It is not necessary to provide plural optical sensors 23 in a one-to-one correspondence with the shutters.

The projections 126 and the concave parts 127 are respectively engaged with the concave parts 227 and projections 226. Accordingly, the developing device shutters 120 and the cartridge shutters 220 can be simultaneously opened or closed in linking with each other. It is not necessary to provide an additional mechanism for moving the cartridge shutter 220 and thus the structure can be simplified.

The developing device shutter 120 and the cartridge shutter 220 are engaged with each other by moving the drawer 71 obliquely downward and backward. Thus, the structure can be simplified as compared with a structure, in which the shutters are engaged by moving the drawer 71 in the left-right direction. Particularly, the drawer 71 can be easily moved downward using gravity and thus the drawer 71 can be easily mounted to the apparatus main body 2 as compared with a structure wherein the shutters are engaged by moving the drawer 71 in the left-right direction or upward.

The invention is not limited to the specific embodiment described above and can be used in various modes as illustrated below:

In the embodiment described above, the invention is applied to the color printer 1, but is not limited to it; the invention may be applied to other image formation apparatus, such as a copier and a multifunction device.

In the embodiment described above, the developing device shutters 120 are moved in the array direction of the developing devices 72, but the invention is not limited to it; the developing device shutters 120 may be moved in the direction orthogonal to the array direction of the developing devices 72. In the embodiment described above, the developing device shutters 120 are moved in the array direction of the developing devices 72 to open or close the openings 74A of the developing devices 72 simultaneously, but the invention is not limited to the mode. For example, each shutter may be jointed to a rotating arm so as to open or close the shutters at different timings.

In the embodiment described above, the member for joining the developing device shutters 120 (shutter joint 130) is provided, but the invention is not limited to the mode. For example, each developing device shutter may be formed to have such a size as to come in contact with its adjacent developing device shutter, and the developing device shutters may be directly joined with an adhesive, etc.

In the embodiment described above, the optical sensor 23 is adopted as a sensor for detecting the position of the shutter operation part 132, but the invention is not limited to it. For example, the sensor may be a switch-type (mechanical) sensor which is turned on as it is pressed by the third extension part 136.

In the embodiment described above, the drawer 71 including the developing devices 72 as a unit construction is moved obliquely downward and backward to engage the developing device shutters 120 with the cartridge shutters 220, but the invention is not limited to the mode; the shutters may be engaged at least by moving the drawer 71 upward or downward. That is, for example, a structure, in which the drawer 71 is once abutted against the back wall of the apparatus main body 2 and then moved downward may be adopted. A structure for moving the drawer 71 obliquely upward and backward may be adopted, for example.

In the embodiment described above, the projections 126 and 227 projecting in the left-right direction and the concave parts 227 and 127 dented in the left-right direction may be adopted as the engagement parts and the engaged parts, but the invention is not limited to the mode. For example, projections projecting in the up and down direction and the concave parts dented in the up and down direction may be adopted as the engagement parts and the engaged parts.

What is claimed is:

1. An image formation apparatus configured to mount developing devices, each of the developing devices having an opening and developer cartridge for respectively supplying a developing agent to the openings of the developing devices, the apparatus comprising:

developing device shutters each configured to open and close a respective one of the openings of the developing devices when mounted to the apparatus;

a link mechanism configured to move the developing device shutters in linking with each other; and a support member configured to support the developing devices, wherein the support member and the developing devices when supported by the support member are configured to be moved to and from a position defined in the apparatus as unit construction by moving the support member in a predetermined direction.

2. The image formation apparatus as claimed in claim 1, wherein:

a direction in which the developing devices when mounted in the apparatus are arrayed is substantially parallel to a predetermined direction;

the link mechanism includes a shutter operation part operable by a user to move the developing device shutters;

the support member includes a developing device operation part operable by the user to move the support member and the developing devices supported by the support member as the unit construction; and the shutter operation part and the developing device operation part are located in a side of the apparatus where the support member is removed from the apparatus.

3. The image formation apparatus as claimed in claim 2, further comprising a sensor configured to detect a position of the shutter operation part.

4. The image formation apparatus as claimed in claim 3, further comprising cartridge shutters, each disposed between a respective one of the developer cartridges when mounted to the apparatus and a respective one of the developing devices when mounted to the apparatus, each of the cartridge shutters having a first engagement part, wherein:

each of the developing device shutters has a second engagement part for engagement with a respective one of the first engagement parts; and the developing device shutters and the cartridge shutters are configured to be moved in linking with each other by engagement between the first and second engagement parts.

5. The image formation apparatus as claimed in claim 4, wherein:

after the support member and the developing devices supported by the support member are inserted into the apparatus main body in the predetermined direction, the support member and the developing devices supported by the support member are guided at least in an upward or downward direction intersecting the predetermined direction to reach a mounted position; and the developing device shutters and the cartridge shutters are engaged with each other through the first and second engagement parts when the support member and developing devices supported by the support member reach the mounted position.

* * * * *